US005543382A

United States Patent [19]

Watanabe et al.

[11] Patent Number: 5,543,382

[45] Date of Patent: Aug. 6, 1996

[54] HEAT-SENSITIVE RECORDING PAPER

[75] Inventors: Kazuo Watanabe, Itami; Masatoshi Okuda, Ibaraki; Shigeo Aoyama, Toyonaka; Yoshimasa Tanaka, Nichinan, all of Japan

[73] Assignee: New Oji Paper Co., Ltd., Tokyo-to, Japan

[21] Appl. No.: 359,646

[22] Filed: Dec. 20, 1994

[30] Foreign Application Priority Data

Dec. 27, 1993 [JP] Japan ..... 5-331211
Sep. 19, 1994 [JP] Japan ..... 6-223191

[51] Int. Cl.[6] ..... B41M 5/30; B41M 5/40

[52] U.S. Cl. ..... 503/224; 427/152; 503/200; 503/226

[58] Field of Search ..... 427/152; 503/200, 503/226, 224

[56] References Cited

U.S. PATENT DOCUMENTS 5,447,899 9/1995 Matoba et al. ..... 503/200

FOREIGN PATENT DOCUMENTS 181687 10/1983 Japan ..... 503/214
61-108581 5/1986 Japan ..... 503/200
38383 2/1991 Japan ..... 428/488.1
38387 2/1991 Japan ..... 428/488.1
218892 9/1991 Japan ..... 428/488.1

*Primary Examiner*—Bruce H. Hess
*Attorney, Agent, or Firm*—Larson and Taylor

[57] ABSTRACT

Disclosed is a heat-sensitive recording paper comprising (a) a support made of glassine paper, (b) a resin layer formed on one side or both sides of the support, and (c) a heat-sensitive recording layer containing a leuco dye and a color developing material which develops a color on contact with the leuco dye, the resin layer being formed by coating one side or both sides of the support with an organic solvent coating composition prepared by dissolving a resin in an organic solvent, followed by drying, and the heat-sensitive recording layer being formed on the resin layer or on the side of the support not having the resin layer thereon, wherein the organic solvent coating composition may further contain a pigment in an amount of about 3 to about 25% by weight based on the amount of the resin.

21 Claims, No Drawings

HEAT-SENSITIVE RECORDING PAPER

BACKGROUND OF THE INVENTION

The present invention relates to a heat-sensitive recording paper which makes use of the color forming reaction of a colorless or pale-colored leuco dye with a color developing material, and more particularly to a heat-sensitive recording paper which is useful in producing a design drawing or usable as a master copy or a mother print for reproduction on a diazo type paper.

Heat-sensitive recording papers are well known which make use of the color forming reaction of a colorless or pale-colored leuco dye with a color developing material such that the two components are reacted by means of a thermal energy generated from a thermal head to produce a color image.

Since such heat-sensitive recording papers are relatively inexpensive and usable on a compact recording machine with an easy maintenance, the recording papers are not only used as recording media for facsimile machines, various computers or the like but also used for other various purposes.

Among such various purposes, three is a demand for heat-sensitive recording papers which are usable for producing design drawings or useful as a master copy for producing a copy on a diazo type paper (hereinafter called "diazo-copying"). To meet this demand, there have been developed heat-sensitive recording materials which have a support made of a transparent film or heat-sensitive recording materials which have a support made of a wood-free paper impregnated with a thermoplastic resin (Japanese Unexamined Patent Publications (Kokai) Nos. 53094/1981, 15013/1982, 103892/1982 and 108581/1986).

However, the heat-sensitive recording materials having as a support a film of a resin such as polypropylene, polyethylene terephthalate or the like are disadvantageous because the resin films used as a support are more expensive than papers, leading to increased production costs and because the films, when bent, tend to fog in the bent portion.

For use in producing a design drawing or a mother print (or a master copy) for producing diazo print, heat-sensitive recording papers are required to produce record images of high color density and to have an unrecorded portion of low opacity in order to form a sharp image in diazo print. When the recording paper has a support such as wood-free paper impregnated with a thermoplastic acrylic resin or the like, it is necessary to use a large amount of the resin to impart a high transparency. In this case, however, the recording paper disadvantageously shows lower image stability and has poor folding endurance so that it can not be stored as folded.

SUMMARY OF THE INVENTION

It is an object of the present invention to provide a heat-sensitive recording paper of low opacity (i.e., having transparency), which is capable of forming record images of high color density, which is usable for producing design drawings or usable as a master copy for diazo-copying, and which can be stored or retained as folded.

The present invention provides a heat-sensitive recording paper comprising:

(a) a support made of glassine paper having an opacity of up to 75% as determined according to JIS P 8138, (b) a resin layer formed on one side or both sides of the support, and (c) a heat-sensitive recording layer containing a leuco dye and a color developing material which develops a color on contact with the leuco dye, the resin layer being formed by coating one side or both sides of the support with an organic solvent coating composition prepared by dissolving a resin in an organic solvent, followed by drying, and the heat-sensitive recording layer being formed on the resin layer or on the side of the support not having the resin layer thereon.

The invention also provides a heat-sensitive recording paper comprising:

(a) a support made of glassine paper having an opacity of up to 75% as determined according to JIS P 8138, (b) a resin layer formed on one side or both sides of the support, and (c) a heat-sensitive recording layer containing a leuco dye and a color developing material which develops a color on contact with the leuco dye, the resin layer being formed by coating one side or both sides of the support with an organic solvent coating composition prepared by dissolving a resin in an organic solvent, followed by drying, wherein the organic solvent coating composition further contains a pigment in an amount of about 3 to about 25% by weight based on the amount of the resin calculated as solid, and the heat-sensitive recording layer being formed on the resin layer or on the side of the support not having the resin layer thereon.

The present inventors conducted extensive research to achieve the foregoing object, and found that the object can be achieved by coating one side or both sides of the glassine paper support with an organic solvent coating composition prepared by dissolving a resin in an organic solvent, followed by drying, to provide a resin layer thereon and then forming a heat-sensitive recording layer containing a leuco dye and a color developing material on the resin layer or on the support.

The inventors' research also revealed that while the organic solvent coating composition can give a satisfactory result, a blister may develop in the resin layer formed over the glassine paper support during drying depending on the kind of the resin used, drying temperature or some other factors. If a blister occurs, an adhesion between the resulting resin layer and the heat-sensitive recording layer tends to be decreased, with the result that edge dust (i.e., a powder derived from a dried heat-sensitive recording layer coating composition) is released from the heat-sensitive recording layer when the recording paper is folded or cut by a slitter.

The inventors made further investigations to mitigate this problem, and found that when a pigment is added to the organic solvent coating composition, said problem will be eliminated, that is, little or no edge dust is produced when the recording paper is folded or cut by a slitter and that the presence of a pigment can achieve a superior effect of forming a record image with a higher uniformity over the entire surface of the recording paper.

The present invention has been accomplished based on these findings.

DESCRIPTION OF THE INVENTION

(a) Support made of glassine paper

The glassine paper to be used in the present invention is a thin, dense, supercalendered paper prepared from an intensively beaten, viscous chemical pulp such as LBKP (hardwood bleached kraft pulp), NBKP (softwood bleached kraft pulp), etc. Commonly, glassine paper is also called "friction paper," "glassy paper" and the like, and is used for protective wrapping of foods, cigarette, drugs, metal parts, etc. or is used as a base sheet for the release paper of an adhesive paper.

It is preferable that the glassine paper for use in the invention has an opacity of up to 75%, more preferably about 40 to about 70%. Herein, the values of opacity are those determined by the method according to JIS P 8138. The glassine papers useful in the invention are those weighing about 15 to about 100 g/m$^2$ preferably about 20 to about 80 g/m$^2$.

A particularly preferred glassine paper is one obtainable by intensively beating a suspension of chemical pulp having a pulp concentration of 0.2 to 5% by weight to a freeness value (Canadian standard freeness) of 120 cc or less with use of a beater or a sand mill.

(b) Resin layer

According to the research of the inventors, if an aqueous coating composition for forming a heat-sensitive recording layer is applied directly to the glassine paper, a problem of inducing wrinkles or paper breaks will occur during the production of heat-sensitive recording papers, and the record images formed on the recording layer are degraded due to the resulting wrinkles.

This problem can be obviated by coating one side or both sides of glassine paper with the organic solvent coating composition prepared by dissolving a resin in a solvent, followed by drying. The amount of the coating composition to be applied is not particularly limited, but generally about 0.2 to about 5 g/m$^2$ preferably about 0.5 to about 3 g/m$^2$ by dry weight By applying the organic solvent coating composition to the glassine paper support, followed by drying, the resin is impregnated into the surface of glassine paper (resin-impregnated layer) or forms a resin film or resin coating thereon (resin coating layer). Basically, the resin layer thus formed appears to function as a waterproof undercoating layer or wrinkle inhibitory layer.

As described above, when the organic solvent coating composition containing only the resin as dissolved therein is applied, a blister may possibly develop on the resin layer over the glassine paper during drying depending on the kind of resin or the drying temperature. If a blister occurs on the resin layer, the surface smoothness of the resin layer would be deteriorated, and an adhesion between the resin layer and the heat-sensitive layer would be lowered, thereby tending to release edge dust when the recording paper is folded or cut by a slitter.

According to a preferred embodiment of the present invention, this problem is solved by incorporating a pigment into the organic solvent coating composition in an amount of about 3 to about 25% by weight, preferably about 5 to about 20% by weight, based on the resin calculated as solid.

In this case, if the pigment content is less than 3% by weight based on the resin, there would be no problem in respect of diazo-copying suitability, transparency, color density of the record image, but a blister may develop during drying depending on the resin used, drying temperature, etc., and an adhesion between the resin layer and the heat-sensitive recording layer may be decreased, thereby tending to reduce the effect of preventing release of edge dust. On the other hand, if the pigment content is over 25% by weight, the opacity of the resulting heat-sensitive recording paper tends to be increased, so that it will be difficult to use the resulting recording paper for producing design drawings or as a master copy for producing diazo print.

When the organic solvent coating composition containing the pigment is used according to the preferred embodiment of the invention, the amount of the composition to be applied is preferably about 0.2 to about 8 g/m$^2$, more preferably about 1 to about 6 g/m$^2$.

The resin contained in the organic solvent coating composition to be applied to the glassine paper is suitably selected from a wide range of resins without specific limitation, insofar as the resin can be dissolved in an organic solvent and the resin, when applied in the form of the organic solvent coating composition and dried, can form a resin layer (resin-impregnated layer or resin coating layer) on the glassine paper by its impregnation into the glassine paper or formation of a film thereon.

Examples of such resins are (meth)acrylic acid ester resins such as methyl acrylate resin, ethyl acrylate resin, 2-ethylhexyl acrylate resin, decyl acrylate resin, isobutyl methacrylate resin, 2-ethylhexyl methacrylate resin, etc., vinyl acetate resin, polyester resin such as unsaturated polyester resin and polyethylene terephthalate, epoxy resin, urethane resin, ethylene-vinyl acetate copolymer, butyral resin, nitrocellulose, polystyrene, a copolymer comprising styrene and methyl methacrylate as comohomers, a copolymer comprising styrene and ethyl methacrylate as comonomers, a copolymer comprising styrene and methyl acrylate as comonomers, a copolymer comprising terephthalic acid and ethylene glycol as comonomers, a copolymer comprising vinyl chloride and vinyl acetate as comonomers, phenolic resin, etc.

These resins can be used singly or at least two of them are usable in mixture.

The molecular weight of the resin is not specifically limited and preferred resins are those having a weight average molecular weight of about 5,000 to about 500,000, preferably about 10,000 to about 300,000, as measured by GPC (gas permeation chromatography) method. If the resin has a weight average molecular weight below 5,000, fogging is likely to occur in the heat-sensitive recording layer, whereas a weight average molecular weight of more than 500,000 tends to increase the viscosity of the organic solvent coating composition, resulting in increased amount of a diluent organic solvent used for the adjustment of the viscosity and in decreased operational efficiency.

Among said resins, preferred are a copolymer comprising styrene and methyl methacrylate as comonomers, a copolymer comprising terephthalic acid and ethylene glycol as comonomers, and a copolymer comprising vinyl chloride and vinyl acetate as comonomers, since these copolymers improve the stability of the record images, and are excellent in miscibility with the pigment and in adhesion with the heat sensitive recording layer. These copolymers can be used in combination.

The monomer composition of these copolymers is not particularly limited in the invention. Particularly preferred copolymers include, for example, a copolymer comprising 20 to 500 parts by weight of a methyl methacrylate unit and 100 parts by weight of a styrene unit, a copolymer comprising a terephthalic acid unit (A) and an ethylene glycol unit (B) in an A : B molar ratio of 1 : 1, and a copolymer comprising 80 to 120 parts by weight of a vinyl acetate unit and 100 parts by weight of a vinyl chloride unit. Among them, preferred is a copolymer comprising 80 to 120 parts by weight of a vinyl acetate unit and 100 parts by weight of a vinyl chloride unit.

Organic solvents to be used for dissolving the resin therein are not specifically limited if they can dissolve the resin therein, but preferred solvents are those having a boiling point of about 60° to about 150° C. under the atmospheric pressure. Particularly preferred organic solvents are suitably selected from toluene, xylene, ethanol, methanol, methyl ethyl ketone, etc. Ethyl acetate is also preferred. These organic solvents can be used singly or at least two of them are usable in mixture.

The concentration of the resin in the organic solvent coating composition to be applied to the glassine paper support is not critical, but is preferably in the range of about 10 about 50% by weight based on the total coating composition in view of the viscosity of the coating composition or ease of coating operation.

Pigments to be incorporated in the organic solvent coating composition according to the preferred embodiment of the invention include various inorganic and organic pigments. Examples of useful inorganic pigments are clay, dickite, nacrite, kaolin, aluminum hydroxide, magnesium hydroxide, calcium carbonate, calcined clay, amorphous silica, alumina, calcined kaolin, barium sulfate, titanium oxide, etc. Useful pigments further include these inorganic pigments which is surface-treated with a hydrophobic organic compound such as beef tallow, and various plastic pigments such as urea-formalin resin pigment, melamine-formalin resin pigment, etc. Said surface-treated pigments are preferred, since they are readily dispersible in the organic solvent.

Said surface-treated pigments can be prepared, for example, by melting a hydrophobic organic compound such as beef tallow and mixing about 0.1 to about 5% by weight, based on the pigment, of the melt with the pigment to coat the pigment surface therewith.

The average particle size of said pigment is not so critical in the invention, but is generally in the range of about 0.1 to about 8 μm, preferably about 0.1 to about 5 μm.

The pigment-free or pigment-containing organic solvent coating composition is applied using a suitable coater conventionally used such as a bar coater, contra coater, gravure coater, curtain coater, champflex coater, roll coater, blade coater, etc. and then dried in a conventional manner, for example, with use of a hot air drier, at a temperature of about 80° to 150 ° C. The foregoing coating composition may be applied to one side or both sides of the glassine paper support.

(c) Heat-sensitive recording layer

The heat-sensitive recording layer is formed preferably on the resin layer over the glassine paper, but it may be optionally formed, of course, on the glassine paper side uncoated with the resin.

Various known leuco dyes conventionally used can be incorporated in the heat-sensitive recording layer. Examples of such leuco dyes are triarylmethane-based dyes such as 3,3-bis(p-dimethylaminophenyl)-6-dimethylaminophthalide, 3,3-bis(p-dimethylaminophenyl)phthalide, 3,3-bis(9-ethylcarbazol-3-yl)- 6-dimethylaminophthalide,3,3-bis(2-phenylindol-3-yl)-6-dimethylaminophthalide, 3-(p-dimethylaminophenyl)-3-(1-methylpyrrol- 3-yl)-6-dimethylaminophthalide, 3-(p-dibenzylaminophenyl)- 3-(1, 2-dimethylindol-3-yl)-7-azaphthalide and the like; diphenylmethane-based dyes such as 4,4'-bis(dimethylamino)benzhydryl benzyl ether, benzhydryl-p-toluenesulfinic acid ester and the like; divinylphthalide-based dyes such as 3,3-bis[1,1-bis(4-pyrrolidinophenyl)ethylen- 2-yl]-4,5,6,7-tetrabromophthalide and the like; thiazine-based dyes such as 3,7-bis(diethylamino)- 10-benzoylphenoxazine, benzoylleucomethylene blue, p-nitrobenzoyl-leucomethylene blue and the like; spiro-based dyes such as 3-methylspirodinaphthopyrane, 3-ethyl-spiro-dinaphthopyrane, 3-phenylspiro-dinaphthopyrane, and the like; lactam-based dyes such as rhodamine-B-anilinolactam, rhodamine(p-nitroanilino)lactam, rhodamine(o-chloroanilino)lactam and the like; fluoran-based dyes such as 3-diethylamino-6-methylfluoran, 3-diethylamino-6-methyl-7-chlorofluoran, 3-diethylamino- 6,7-dimethylfluoran, 3-(N-ethyl-p-toluidino)-7-methylfluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-di(n-butyl)amino-6-methyl-7-phenylaminofluoran, 3-dipentylamino-6-methyl-7-phenylaminofluoran, 3-(N-ethyl-N-isoamylamino)-6-methyl-7-phenylaminofluoran, 3-dibutylamino-7-(o-chlorophenylamino)fluoran, 3-diethylamino-7-(o-fluorophenylamino)fluoran, 3-dibutylamino-7-(o-fluorophenylamino)fluoran, 3-diethylamino-6-chloro-7-phenylaminofluoran, 3-(N-ethyl-N-p-tolylamino)-7-methylfluoran and the like; fluorene-based dyes such as 3,6-bis(dimethylamino)fluorene- 9-spiro-3'-(6'-dimethylamino)phthalide, 3,6-bis(dimethylamino)-3'-methylspiro[fluorene- 9,6'-6'H-chromeno(4,3-b)indole], 3,6-bis(diethylamino)- 3'-methyl-spiro[fluorene-9,6'-6'H-chromeno(4,3-b)indole] and the like. The dyes useful in the invention are not limited to the examples given above, and at least two of them may be conjointly used.

In the heat-sensitive recording paper of the invention, various known and conventional color developing materials can be used which develop a color on contact with the leuco dye in the recording layer. Examples of such color developing materials are phenolic compounds such as 4,4'-sec-butylidenediphenol, 4-phenylphenol, 4,4'-dihydroxydiphenylmethane, 4,4'-isopropylidenediphenol, 4,4'-cyclohexylidenebisphenol, 4,4'-[1,3-phenylenebis(1-methylethylidene)]bisphenol, 4,4'-(1,3-dimethylbutylidene)bisphenol, 4,4'-dihydroxydiphenylsulfone, 2,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3',4'-tetramethylenediphenylsulfone, 3,4-dihydroxy-4'-methyldiphenylsulfone, bis(3-allyl-4-hydroxyphenyl)sulfone, 4-hydroxybenzoic acid-p-methoxybenzylester, novolak-type phenol resins, phenol polymers and the like; sulfonyl urea derivatives such as 4,4'-bis(p-toluenesulfonylaminocarbonylamino)diphenylmethane and the like; aromatic carboxylic acids such as 3,5-dimethyl-4-hydroxybenzoic acid, 3-isopropylsalicylic acid, 3,5-di-tert-butylsalicylic acid, 3-benzylsalicylic acid, 3-(α-methylbenzyl)salicylic acid, 3-chloro- 5-(α-methylbenzyl)salicylic acid, 3-phenyl-5-(α, α-dimethylbenzyl)salicylic acid, 3,5-di-α-methylbenzylsalicylic acid, 4-(2-p-methoxyphenoxyethoxy)salicylic acid, 4-(3-p-tolylsulfonylpropyloxy)salicylic acid and the like; salts of the above phenolic compounds or aromatic carboxylic acids with polyvalent metals such as zinc, magnesium, aluminum and the like; and other organic acidic substances. Among them, 4,4'-bis(p-toluenesulfonylaminocarbonylamino)diphenylmethane is preferable, since it gives excellent stability of the record images. When necessary, at least two of these color developing materials can be used in mixture.

The color developing material is used in an amount of about 1 to about 10 parts by weight, preferably about 1 to about 5 parts by weight, per part by weight of the leuco dye.

In the present invention, a sensitizing agent may be used according to the intended purpose. Examples of useful sensitizing agents are 1,2-di(3-methylphenoxy)ethane, 1,2-diphenoxyethane, 1-phenoxy-2-(4-methylphenoxy)ethane, parabenzylbiphenyl, naphthyl benzyl ether, benzyl-4-methylthiophenylether, 1-hydroxy-2-naphthoic acid phenyl ester, oxalic acid dibenzyl ester, oxalic acid di-p-methylbenzyl ester, oxalic acid di-p-chlorobenzyl ester, terephthalic acid dimethyl ester, terephthalic acid dibutyl ester, terephthalic acid dibenzyl ester, isophthalic acid dibutyl ester, 1-hydroxynaphthoic acid phenyl ester and various known heat-fusible substances, etc. Among these sensitizing agents, particularly preferred are 1,2-di(3-methylphenoxy)ethane, 1,2-diphenoxyethane and 1-phenoxy-2-( 4-methylphenoxy)ethane.

The amount of the sensitizing agent to be used is not specifically limited, but it is usually about 400 parts by weight or less, preferably about 100 to about 400 parts by weight, per 100 parts by weight of the color developing material.

For improving the stability of the record images, stability improving agents can be added. Examples of such stability improving agents are phenolic compounds such as 1,3,5-tris(4-tert-butyl-3-hydroxy-2,6-dimethylbenzyl)isocyanuric acid, 1,1,3-tris(2-methyl-4-hydroxy-5-tert-butylphenyl)butane, 1,1,3-tris(2-methyl-4-hydroxy-5-cyclohexylphenyl)butane, 1,1-bis(2-methyl-4-hydroxy-5-tert-butylphenyl)butane and the like; and diphenylsulfone derivatives such as 4-(2-methyl-1,2-epoxyethyl)diphenylsulfone, 4-(2-ethyl-1,2-epoxyethyl)diphenylsulfone, 4-(2-methyl-glycidyl)diphenylsulfone, 4-(2-ethyl-glycidyl)-diphenylsulfone, 4-(2-butyl-glycidyl)diphenylsulfone, 4-(3-methyl-3,4-epoxybutyl)diphenylsulfone, 4-(2-methyl-3,4-epoxybutyl)diphenylsulfone, 4-(2-methyl-2,3-epoxybutyl)diphenylsulfone, 4-(2-methyl-glycidyloxy)-2',4'-dichlorodiphenylsulfone, 4-(2-methyl-glycidyloxymethoxy)diphenylsulfone, 4-benzyloxy-4'-(2,3-glycidyloxy)diphenylsulfone, 4-(2-methyl-glycidyloxy)-4'-(p-methoxybenzyloxy)diphenylsulfone and the like. The stability improving agents useful in the invention are not limited to those exemplified above and at least two of them can be used in combination.

The color developing material, sensitizing agent, stability improving agent and the like are dispersed, each separately or together with the leuco dye, in water acting as a dispersing medium using a wet-type grinder such as a sand grinder, attritor, ball mill, cobol mill or the like, optionally in the presence of other components such as water-soluble synthetic high-molecular compounds such as polyacrylamide, polyvinylpyrrolidone, polyvinyl alcohol, carboxymethyl cellulose and styrene-maleic anhydride copolymer salt and derivatives thereof, surfactants, etc. The dispersion thus obtained is used in preparing the coating composition for forming the recording layer.

Other components which may be used for forming the heat-sensitive recording layer are adhesives (binders), inorganic or organic pigments, waxes, metallic soaps and water resistance improving agents, and further when necessary, ultraviolet absorbers, fluorescent dyes, coloring agents, etc.

Any of the adhesive resins conventionally used in the art can be used as the binder in the present invention. Examples of the adhesive resins (binders) are water-soluble and/or water-dispersible resins such as polyvinyl alcohol, carboxy group-modified polyvinyl alcohol, acetoacetyl group-modified polyvinyl alcohol, cation group-modified polyvinyl alcohol, sulfone group-modified polyvinyl alcohol, silicon-modified polyvinyl alcohol, starches and their derivatives, casein, methyl cellulose, hydroxyethyl cellulose, hydroxymethyl cellulose, polyacrylamide, styrene-maleic anhydride copolymer, styrene-butadiene latex, vinyl acetate-acrylic acid ester copolymer emulsion, polyurethane emulsion, polyvinyl chloride emulsion, polyvinylidene chloride emulsion, methacrylic acid ester copolymer emulsion, acrylic acid ester copolymer emulsion, etc. Further, for enhancing the water-resistance of the heat-sensitive recording layer, it is preferable to use a water-soluble and/or water-dispersible resin adhesive containing a reactive group such as an acetoacetyl group, carboxyl group, amido group or the like in combination with a crosslinking agent. The binder is usually used in an amount of about 5 to about 30% by weight, preferably about 10 to about 20% by weight, based on the total solids content of the heat-sensitive recording layer.

Examples of the crosslinking agents useful in the invention include polyvalent aldehyde compounds such as glyoxal, glutaraldehyde, dialdehyde starch and the like, polyamine compounds such as polyethyleneimine and the like, epoxy compounds, polyamide resins, diglycidyl compounds such as glycerine diglycidyl ether and the like, dimethylolurea compounds, inorganic compounds such as ammonium persulfate, ferric chloride, magnesium chloride and the like, boric acid and borax.

Useful pigments include, for example, fine powder of inorganic materials such as clay, calcium carbonate, magnesium carbonate, talc, silica, diatomaceous earth, synthetic aluminum silicate, zinc oxide, titanium oxide, aluminum hydroxide, barium sulfate, surface-treated calcium carbonate and silica and the like, and fine particles of organic resins such as urea-formalin resin, styrene-methacrylic acid copolymer, polystyrene resin and the like.

Examples of the wax include, for example, paraffin wax, carnauba wax, microcrystalline wax, polyethylene wax, higher fatty acid amides such as stearic acid amide, ethylenebisstearic acid amide and the like, higher fatty acid esters, and the like.

The method of forming the heat-sensitive recording layer is not specifically limited and conventional method can be employed. For example, the coating composition for forming the recording layer is preferably applied in an amount of about 2 to about 12 g/m$^2$ preferably about 3 to about 10 g/m$^2$, by dry weight by air knife coating, Vari-bar blade coating, pure blade coating, rod blade coating, short dwell coating, curtain coating, die coating or other suitable coating methods.

(d) Protective layer

When required, a protective layer comprising a water-soluble adhesive and a pigment can be formed on the heat-sensitive recording layer to further improve the transparency and the recording properties of the heat-sensitive recording paper.

Useful adhesives for such protective layer include those having excellent film-forming properties, such as water-soluble resins selected from the group consisting of starches, hydroxyethyl cellulose, methyl cellulose, carboxymethyl cellulose, gelatin, casein, gum arabic, polyvinyl alcohol, carboxy-modified polyvinyl alcohol, acetoacetyl group-modified polyvinyl alcohol, silicon-modified polyvinyl alcohol, diisobutylene-maleic anhydride copolymer salt, styrene-maleic anhydride copolymer salt, ethylene-acrylic acid copolymer salt, styrene-acrylic acid copolymer salt, urea resin, melamine resin, amide resin, polyurethane resin and the like. Among them, acetoacetyl group-modified polyvinyl alcohol and carboxy-modified polyvinyl alcohol are preferably used, since they form a coating film of high strength and have high transparency.

The protective layer contains a pigment to improve the suitability for printing and to prevent sticking, i.e., the phenomenon that the recording paper sticks to the thermal head during the recording operation.

Preferred pigments are those having an average particle size of about 0.01 to about 5 μm. Examples of such pigments are inorganic pigments such as calcium carbonate, zinc oxide, aluminum oxide, titanium dioxide, silicon dioxide, aluminum hydroxide, barium sulfate, zinc sulfate, talc, kaolin, clay, calcined kaolin, colloidal silica, etc. and organic pigments such as styrene microballs, nylon powder, polyethylene powder, urea-formalin resin fillers, raw starch particles, etc. These pigments can be used alone or at least two of them are usable in combination.

A preferred amount of the pigment to be used is about 5 to 300 parts by weight per 100 parts by weight of the binder component (i.e., adhesive).

The adhesive and the pigment are dispersed in water to provide a coating composition for forming a protective layer. The obtained composition is applied to the heat-sensitive recording layer and dried.

When required, the protective layer coating composition may further contain auxiliary agents including lubricants such as zinc stearate, calcium stearate, polyethylene wax, carnauba wax, paraffin wax, ester wax, etc., surfactants (dispersants, wetting agents, etc.) such as sodium dioctylsulfosuccinate, etc., defoaming agents, and water-soluble polyvalent metal salts such as potassium alum, aluminum acetate, etc. A curing agent, such as glyoxal, boric acid, dialdehyde starch, epoxy compounds, etc. can be added in order to further improve the water resistance of the protective layer. The protective layer may further contain a crosslinking agent and a lubricant in addition to the adhesive and the pigment.

The proportions of the adhesive resin to the pigment range from 80 : 20 to 20 : 80. In other words, 80 to 20% by weight of the adhesive resin and 20 to 80% by weight of the pigment are used based on the total amount of the two components. If the amount of adhesive resin exceeds 80% by weight, sticking may occur during the recording operation; and during the printing, the adhesion of the printing ink tends to be reduced.

The preferred adhesive to be incorporated in the protective layer is acetoacetyl group-modified polyvinyl alcohol. The amount of the acetoacetyl group-modified polyvinyl alcohol to be used is about 15 to about 60% by weight, preferably about 20 to about 50% by weight, based on the total solids of the protective layer. Further advantageously, when boric acid is added in an amount of about 0.5 to about 5% by weight, preferably about 1 to about 3% by weight, based on the amount of the acetoacetyl group-modified polyvinyl alcohol, the water resistance and the recording properties are further improved.

These acetoacetyl group-modified polyvinyl alcohols are known and are readily available. They are disclosed, for example, in Japanese Unexamined Patent Publication (Kokai) No. 181687/1983. Particularly preferred acetoacetyl group-modified polyvinyl alcohols include, for example, those having a polymerization degree of about 500 to about 2,000 and containing acetoacetyl groups in an amount of about 1 to about 10 mole % based on the vinyl alcohol monomer.

The method of forming the protective layer is not specifically limited. It is desirable in the present invention to apply the protective layer coating composition in an amount of 0.5 to 7 g/m$^2$ preferably 1 to 4 g/m$^2$, by dry weight by a suitable coating method such as air knife coating, Vari-bar blade coating, pure blade coating, rod blade coating, short dwell coating, curtain coating, die coating, etc.

Various modifications are possible without departing from the intended scope of the invention. For example, to prevent curling, a rear side layer (back coating) may be formed, when so required, on the opposite side of the heat-sensitive recording layer in the heat-sensitive recording paper of the invention. The rear side layer can be produced from the same coating composition by the same method as those used for forming the protective layer, and also the amount of the compositions to be applied and the resin/pigment ratio may be varied when so required. Further optionally, an undercoat layer may be provided under the recording layer. Other techniques used in the art for production of heat-sensitive recording papers can be employed if necessary. For example, after the formation of the recording layer, protective layer and other layers, the recording paper may be subjected to a surface-smoothing procedure such as super-calendering.

EXAMPLES

The present invention will be described below in more detail with reference to the following examples to which, however, the invention is not limited. In the examples and comparative examples, "parts" and "percentages" are all by weight unless otherwise specified.

The weight average molecular weight of the resins used was determined by GPC method.

EXAMPLE 1

(1) Preparation of Dispersion A

A composition comprising 10 parts of 3-di(n-butyl)amino- 6-methyl-7-anilinofluoran, 15 parts of 1,2-di(3-methylphenoxy)ethane, 5 parts of a 5% aqueous solution of methyl cellulose and 60 parts of water was pulverized by a sand mill to a mean particle size of 2 μm.

(2) Preparation of Dispersion B

A composition comprising 35 parts of 4,4'-isopropylidenediphenol, 5 parts of a 5% aqueous solution of methyl cellulose and 60 parts of water was pulverized by a sand mill to a mean particle size of 2 μm.

(3) Preparation of Dispersion C

A 20 part quantity of methyl methacrylate resin (weight average molecular weight: 120,000) was dissolved in 80 parts of toluene using a stirrer.

(4) Application of Dispersion C

Dispersion C was applied, in an amount of 2 g/m$^2$ by dry weight, to one side of a glassine paper support having an opacity of 55% and weighing 40 g/m$^2$, and then dried. The opacity of the paper coated with Dispersion C and dried was 52%.

(5) Formation of recording layer

A recording layer coating composition having the following formulation was applied, in an amount of 5 g/m$^2$ by dry weight, to the Dispersion C-coated side of the glassine paper support and then dried.

The coating composition was prepared by mixing and stirring 100 parts of Dispersion A, 30 parts of Dispersion B, 100 parts of a 10% aqueous solution of polyvinyl alcohol (tradename "PVA110", product of KURARAY Co., LTD.), 10 parts of precipitated calcium carbonate (average particle size : 1.2 μm) and 27 parts of water.

(6) Formation of protective layer

A protective layer coating composition having the following formulation was applied to the foregoing heat-sensitive recording layer in an amount of 2 g/m$^2$ by dry weight and then dried. The paper thus coated was supercalendered, giving a heat-sensitive recording paper.

The above coating composition was prepared by mixing and stirring 60 parts of kaolin (average particle size: 0.8 μm), 300 parts of 10% aqueous solution of polyvinyl alcohol (tradename "PVA110", product of KURARAY Co., LTD.), 25 parts of a 30% aqueous dispersion of zinc stearate and 115 parts of water.

EXAMPLE 2

A heat-sensitive recording paper was prepared in the same manner as in Example 1 except that Dispersion C was applied to both sides of the glassine paper in an amount of 1 g/m$^2$ on each side by dry weight to form a resin layer. The opacity of the paper coated with Dispersion C and dried was 51%.

EXAMPLE 3

A heat-sensitive recording paper was prepared in the same manner as in Example 1 except that Dispersion C was applied in an amount of 5 g/m$^2$ by dry weight to form a resin layer. The opacity of the paper coated with Dispersion C and dried was 47%.

EXAMPLE 4

A heat-sensitive recording paper was prepared in the same manner as in Example 1 except that in the preparation of Dispersion C, a styrene-methyl methacrylate copolymer (the mole ratio of styrene to methyl methacrylate=1:1; the weight average molecular weight: about 70,000) was used in place of methyl methacrylate resin.

EXAMPLE 5

A heat-sensitive recording paper was prepared in the same manner as in Example 1 except that in the preparation of Dispersion C, a polyester resin containing as the main components terephthalic acid and ethylene glycol (the molar ratio of said monomer components=1:1; the weight average molecular weight: 17,000; tradename "Vylon 29SS", product of TOYOBO Co., Ltd.) was used in place of methyl methacrylate resin. (The opacity of the glassine paper coated with Dispersion C and dried was 53%.)

EXAMPLE 6

A heat-sensitive recording paper was prepared in the same manner as in Example 1 except that in the preparation of Dispersion C, 54 parts of a copolymer of vinyl chloride and vinyl acetate (the ratio by weight of monomer components, i.e. vinyl chloride : vinyl acetate=100 : 100; the weight average molecular weight: 8,500; tradename "Kanebilac L-CN", product of Kaneka Corp., solid content: 37%) and 56 parts of toluene were used in place of 20 parts of methyl methacrylate resin and 80 parts of toluene. (The opacity of the glassine paper coated with Dispersion C and dried was 51%.)

EXAMPLE 7

A heat-sensitive recording paper was prepared in the same manner as in Example 1 except that in the preparation of Dispersion B, 4-hydroxy-4'-isopropoxydiphenylsulfone was used in place of 4,4'-isopropylidenediphenol.

EXAMPLE 8

A heat-sensitive recording paper was prepared in the same manner as in Example 1 except that in the preparation of Dispersion B, 4,4'-bis(p-toluenesulfonylaminocarbonylamino)diphenylmethane was used in place of 4,4'-isopropylidenediphenol.

EXAMPLE 9

A heat-sensitive recording paper was prepared in the same manner as in Example 1 except that in formation of the protective layer, 300 parts of a 10% aqueous solution of acetoacetyl group-modified polyvinyl alcohol (containing 5 mole % of acetoacetyl groups based on vinyl alcohol unit; polymerization degree=1000; tradename "Gohsefimer Z-200", product of The Nippon Synthetic Chemical Industry Co., Ltd.) was used in place of 300 parts of 10% aqueous solution of polyvinyl alcohol (tradename "PVA110", product of KURARAY Co., Ltd.).

Comparative Example 1

A heat-sensitive recording paper was prepared in the same manner as in Example 1 except that Dispersion C was not applied.

Comparative Example 2

A heat-sensitive recording paper was prepared in the same manner as in Example 1 except that in the application of Dispersion C, a wood-free paper having an opacity of 76% and weighing 40 g/m$^2$ was used in place of the glassine paper having an opacity of 55% and weighing 40 g/m$^2$. The opacity of the wood-free paper coated with Dispersion C and dried was 62%.

The 11 kinds of the heat-sensitive recording papers thus obtained were tested for quality evaluation. Table 1 shows the results.

Color density

The color density of record images formed with use of a thermal printer (model PC-100R, manufactured by Texas Instruments Corp.) was measured by a Macbeth densitometer (model RD-100R, manufactured by Macbeth Corp.).

Opacity

The opacity of the heat-sensitive recording paper was determined according to JIS P 8138. (The smaller the numerical value is, the higher the transparency is.)

Stability of record image

The heat-sensitive recording paper with images formed by recording was allowed to stand in an atmosphere maintained at 40° C. and 90 %RH for three days. The color density of the recorded portion was measured by a Macbeth densitometer.

TABLE 1

| | Color density | Opacity (%) | Stability |
|---|---|---|---|
| Ex. 1 | 1.34 | 65 | 1.12 |
| Ex. 2 | 1.32 | 60 | 1.11 |
| Ex. 3 | 1.30 | 58 | 1.04 |
| Ex. 4 | 1.33 | 58 | 1.25 |
| Ex. 5 | 1.32 | 65 | 1.18 |
| Ex. 6 | 1.35 | 64 | 1.28 |
| Ex. 7 | 1.37 | 64 | 1.18 |
| Ex. 8 | 1.26 | 65 | 1.24 |
| Ex. 9 | 1.33 | 64 | 1.15 |
| Com. Ex. 1 | 1.22 | 70 | 1.09 |
| Com. Ex. 2 | 1.34 | 75 | 1.17 |

Table 1 shows that the heat-sensitive recording papers according to the present invention are excellent in stability of the record images and are low in opacity so that they are satisfactorily usable for producing design drawings and also usable as a master copy for producing diazo prints.

EXAMPLE 10

(1) Preparation of Dispersion A

A composition comprising 10 parts of 3-di(n-butyl)amino- 6-methyl-7-anilinofluoran, 15 parts of 1,2-di(3-methylphenoxy)ethane, 5 parts of a 5% aqueous solution of methyl cellulose and 60 parts of water was pulverized by a sand mill to a mean particle size of 2 μm.

(2) Preparation of Dispersion B

A composition comprising 35 parts of 4,4'-isopropylidenediphenol, 5 parts of a 5% aqueous solution of methyl cellulose and 60 parts of water was pulverized by a sand mill to a mean particle size of 2 μm.

(3) Preparation of Dispersion C

One part of precipitated calcium carbonate (tradename "PZ", product of SHIRAISHI CALCIUM KAISHA, LTD., average particle size: 0.1 μm) was dispersed in 80 parts of toluene and then 90 parts of a copolymer of vinyl chloride and vinyl acetate (tradename "Kanebilac L-CN", containing 100 wt. % of vinyl acetate based on vinyl chloride, solid concentration of 37%, product of Kaneka Corp.) was dissolved using a stirrer.

(4) Preparation of protective layer coating composition

A protective layer coating composition was prepared by mixing and stirring 80 parts of kaolin (average particle size : 0.8 μm), 400 parts of a 10% aqueous solution of acetoacetyl group-modified completely saponified polyvinyl alcohol (tradename "Gohsefimer Z-200", product of The Nippon Synthetic Chemical Industry Co., Ltd.), 30 parts of a 30% aqueous dispersion of zinc stearate and 140 parts of water.

(5) Application of Dispersion C

Dispersion C was applied to one side of a glassine paper weighing 63 g/m$^2$ and having an opacity of 55% in an amount of 4 g/m$^2$ by dry weight and then hot-air dried at 100° C. for 1 minute.

(6) Formation of heat-sensitive recording layer

A recording layer coating composition having the following formulation was applied, in an amount of 5 g/m$^2$ by dry weight, to the Dispersion C-coated side of the glassine paper and then dried.

The coating composition was prepared by mixing and stirring 100 parts of Dispersion A, 30 parts of Dispersion B, 150 parts of a 10% aqueous solution of polyvinyl alcohol (tradename "PVA-235", product of KURARAY Co., Ltd.), 10 parts of precipitated calcium carbonate and 30 parts of water.

(7) Formation of protective layer

The above protective layer coating composition was applied to the heat-sensitive recording layer in an amount of 3 g/m$^2$ by dry weight and then dried. The paper thus coated was supercalendered, giving a heat-sensitive recording paper.

EXAMPLE 11

A heat-sensitive recording paper was prepared in the same manner as in Example 10 except that Dispersion C was applied to both sides of a glassine paper in an amount of 2 g/m$^2$ by dry weight for each side to form a resin layer and then dried.

EXAMPLE 12

A heat-sensitive recording paper was prepared in the same manner as in Example 10 except that in the preparation of Dispersion C, 1 part of calcium carbonate surface-treated with beef tallow (tradename "Raiton AK", product of Bihokufunka Kogyo Kabushiki Kaisha, average particle size: 4 μm) was dispersed in 80 parts of toluene.

EXAMPLE 13

A heat-sensitive recording paper was prepared in the same manner as in Example 10 except that in the preparation of Dispersion C, 4.5 parts of calcium carbonate surface-treated with beef tallow (tradename "Raiton AK", product of Bihokufunka Kogyo Kabushiki Kaisha) was dispersed in 80 parts of toluene.

Comparative Example 3

A heat-sensitive recording paper was prepared in the same manner as in Example 10 except that Dispersion C was not applied.

EXAMPLE 14

A heat-sensitive recording paper was prepared in the same manner as in Example 10 except that in the preparation of Dispersion C, the precipitated calcium carbonate was not used, and 90 parts of a copolymer of vinyl chloride and vinyl acetate (the weight ratio of monomer components, i.e. vinyl chloride: vinyl acetate=1:1; the weight average molecular weight: 8,500) was dissolved in 80 parts of toluene.

EXAMPLE 15

A heat-sensitive recording paper was prepared in the same manner as in Example 10 except that in the preparation of Dispersion C, 0.5 part of calcium carbonate surface-treated with beef tallow (tradename "Raiton AK", product of Bihokufunka Kogyo Kabushiki Kaisha) was dispersed in 80 parts of toluene.

Comparative Example 4

A heat-sensitive recording paper was prepared in the same manner as in Example 10 except that in the preparation of Dispersion C, 15 parts of calcium carbonate surface-treated with beef tallow (tradename "Raiton AK", product of Bihokufunka Kogyo Kabushiki Kaisha) was dispersed in 80 parts of toluene.

The heat-sensitive recording papers thus obtained were tested for quality evaluation. Table 2 shows the results.

EXAMPLE 16

A heat-sensitive recording paper was prepared in the same manner as in Example 10 except that in the preparation of Dispersion C, a polyester resin containing as the main components terephthalic acid and ethylene glycol (the molar ratio of said monomer components=1:1; the weight average molecular weight: 17,000; tradename "Vylon 29SS", product of TOYOBO Co., Ltd.) was used.

EXAMPLE 17

A heat-sensitive recording paper was prepared in the same manner as in Example 10 except that in the preparation of Dispersion C, 54 parts of a copolymer of vinyl chloride and vinyl acetate (the ratio by weight of monomer components, i.e. vinyl chloride : vinyl acetate=100 : 100; the weight average molecular weight: 8,500; tradename "Kanebilac L-CN", product of Kaneka Corp., solid content: 37%) and 56 parts of toluene were used.

Density of record image

Using a simulator for heat-sensitive recording (model TH-PMD, manufactured by Ohkura Denki Co., Ltd), images were formed with an applied head energy of 0.4 mj/dot. The density of the record images was measured by a Macbeth densitometer (model RD-914, manufactured by Macbeth Corp.).

Opacity

The opacity of the heat-sensitive recording paper was determined according to JIS P 8138.

Edge dust

The heat-sensitive paper was cut over 200 m distance with a slitter and the generation of edge dust was checked with the unaided eye.

Criteria for visual evaluation:

A: Extremely rare generation of edge dust and rated "excellent"

B: Edge dust scarcely generated and rated "good"

C: Some amount of edge dust generated, but substantially no problem arose in practical use.

D: A large amount of edge dust generated, causing a problem in practical use.

Diazo-copying suitability

An image was formed on the heat-sensitive recording paper with use of a thermal plotter (tradename "LTX-120", product of Roland Co., Ltd.). The heat-sensitive recording paper was then used as a master in a diazo copier (model RICOPY SUPER DRY 100; Product of Ricoh Company, Ltd.) to duplicate the image on diazo type copying paper. The density of the reproduced image and the density of the background portion were measured by a Macbeth densitometer.

Blister

Just after the organic solvent coating composition containing a resin dissolved therein was applied to the glassine paper and hot-air dried at 100° C. for 1 minute in each of Examples 10–17 and Comparative Examples 3 and 4, the coated surface of the paper was observed with the unaided eye.

Criteria for visual evaluation:

A: No blister

B: 1 to 10 blisters/$m^2$

C: 11 to 50 blisters/$m^2$

D: 51 or more blisters/$m^2$

TABLE 2

| | Density of record image | Opacity (%) | Edge dust | Diazo-copying suitability: Re-corded portion | Diazo-copying suitability: Back-ground portion | Blister |
|---|---|---|---|---|---|---|
| Ex. 10 | 1.35 | 64 | B | 0.92 | 0.15 | B |
| Ex. 11 | 1.34 | 65 | A | 0.93 | 0.14 | A |
| Ex. 12 | 1.36 | 63 | B | 0.91 | 0.14 | B |
| Ex. 13 | 1.36 | 66 | A | 0.95 | 0.16 | A |
| Com. Ex. 3 | 1.23 | 70 | A | 0.94 | 0.20 | — |
| Ex. 14 | 1.33 | 63 | D | 0.90 | 0.14 | D |
| Ex. 15 | 1.34 | 64 | C | 0.93 | 0.15 | C |
| Com. Ex 4 | 1.36 | 69 | C | 1.02 | 0.24 | A |
| Ex. 16 | 1.35 | 65 | B | 0.91 | 0.15 | B |
| Ex. 17 | 1.34 | 65 | B | 0.90 | 0.16 | B |

Table 2 shows that the heat-sensitive recording papers according to the present invention are excellent in transparency, produce little or no edge dust and are suitable for diazo-copying.

We claim:

1. A heat-sensitive recording paper comprising:

(a) a support made of glassine paper having an opacity of up to 75% as determined according to JIS P 8138, (b) a resin layer formed on one side or both sides of the support, and (c) a heat-sensitive recording layer containing a leuco dye and a color developing material which develops a color on contact with the leuco dye, the resin layer being formed by coating one side or both sides of the support with an organic solvent coating composition prepared by dissolving a resin in an organic solvent, followed by drying, and the heat-sensitive recording layer being formed on the resin layer or on the side of the support not having the resin layer thereon.

2. A heat-sensitive recording paper according to claim 1 wherein the resin is at least one member selected from the group consisting of a copolymer comprising styrene and methyl methacrylate as comonomers, a copolymer comprising terephthalic acid and ethylene glycol as comonomers, and a copolymer comprising vinyl chloride and vinyl acetate as comonomers.

3. A heat-sensitive recording paper according to claim 1 wherein the organic solvent is at least one member selected from the group consisting of toluene, xylene, ethanol, methanol, methyl ethyl ketone and ethyl acetate.

4. A heat-sensitive recording paper according to claim 1 wherein the organic solvent coating composition is applied in an amount of about 0.2 to about 5 g/$m^2$ by dry weight.

5. A heat-sensitive recording paper according to claim 1 wherein the organic solvent coating composition is applied in an amount of about 0.5 to about 3 g/$m^2$ by dry weight.

6. A heat-sensitive recording paper according to claim 1 wherein the color developing material is 4,4'-bis(p-toluenesulfonylaminocarbonylamino)diphenylmethane.

7. A heat-sensitive recording paper according to claim 1 wherein the heat-sensitive recording layer is formed on the resin layer.

8. A heat-sensitive recording paper according to claim 1 wherein a protective layer comprising a water-soluble resin and a pigment is formed on the heat-sensitive recording layer.

9. A heat-sensitive recording paper according to claim 8 wherein the water-soluble resin is acetoacetyl group-modified polyvinyl alcohol, the acetoacetyl group-modified polyvinyl alcohol being used in an amount of about 15 to about 60% by weight based on the total solids of the protective layer, and wherein the protective layer contains boric acid in an amount of about 0.5 to about 5% by weight based on the acetoacetyl group-modified polyvinyl alcohol.

10. A heat-sensitive recording paper comprising:

(a) a support made of glassine paper having an opacity of up to 75% as determined according to JIS P 8138, (b) a resin layer formed on one side or both sides of the support, and (c) a heat-sensitive recording layer containing a leuco dye and a color developing material which develops a color on contact with the leuco dye, the resin layer being formed by coating one side or both sides of the support with an organic solvent coating composition prepared by dissolving a resin in an organic solvent, followed by drying, wherein the organic solvent coating composition further contains a pigment in an amount of about 3 to about 25% by weight based on the amount of the resin, and the heat-sensitive recording layer being formed on the resin layer or on the side of the support not having the resin layer thereon.

11. A heat-sensitive recording paper according to claim 10 wherein the resin is at least one member selected from the group consisting of a copolymer comprising styrene and methyl methacrylate as comonomers, a copolymer comprising terephthalic acid and ethylene glycol as comonomers, and a copolymer comprising vinyl chloride and vinyl acetate as comonomers.

12. A heat-sensitive recording paper according to claim 10 wherein the organic solvent is at least one member selected from the group consisting of toluene, xylene, ethanol, methanol, methyl ethyl ketone and ethyl acetate.

13. A heat-sensitive recording paper according to claim 10 wherein the organic solvent coating composition is applied in an amount of about 0.2 to about 8 $g/m^2$ by dry weight.

14. A heat-sensitive recording paper according to claim 10 wherein the organic solvent coating composition is applied in an amount of about 1 to about 6 $g/m^2$ by dry weight.

15. A heat-sensitive recording paper according to claim 10 wherein the pigment has an average particle size in the range of about 0.1 to about 8 μm.

16. A heat-sensitive recording paper according to claim 10 wherein the pigment is at least one member selected from the group consisting of clay, dickite, nacrite, kaolin, aluminum hydroxide, magnesium hydroxide, calcium carbonate, calcined clay, amorphous silica, alumina, calcined kaolin, barium sulfate, titanium oxide, these pigments surface-treated with a hydrophobic organic compound and plastic pigments.

17. A heat-sensitive recording paper according to claim 10 wherein the pigment is an inorganic pigment surface-treated with beef tallow, the inorganic pigment being at least one member selected from the group consisting of clay, dickite, nacrite, kaolin, aluminum hydroxide, magnesium hydroxide, calcium carbonate, calcined clay, amorphous silica, alumina, calcined kaolin, barium sulfate and titanium oxide.

18. A heat-sensitive recording paper according to claim 10 wherein the color developing material is 4,4'-bis(p-toluenesulfonylaminocarbonylamino)diphenylmethane.

19. A heat-sensitive recording paper according to claim 10 wherein the heat-sensitive recording layer is formed on the resin layer.

20. A heat-sensitive recording paper according to claim 10 wherein a protective layer comprising a water-soluble resin and a pigment is formed on the heat-sensitive recording layer.

21. A heat-sensitive recording paper according to claim 20 wherein the water-soluble resin is acetoacetyl group-modified polyvinyl alcohol, the acetoacetyl group-modified polyvinyl alcohol being used in an amount of about 15 to about 60% by weight based on the total solids of the protective layer, and wherein the protective layer contains boric acid in an amount of about 0.5 to about 5% by weight based on the amount of the acetoacetyl group-modified polyvinyl alcohol.

* * * * *